US007062928B2

(12) United States Patent
Karlsson et al.

(10) Patent No.: US 7,062,928 B2
(45) Date of Patent: Jun. 20, 2006

(54) COOLING APPARATUS AND METHOD

(75) Inventors: Arne Karlsson, Motala (SE); Ingemar Hallin, Lidingö (SE); Carl Lindhagen, Motala (SE); Fredrik Reithe, Linköping (SE); Anton Lundqvist, Älvsjö (SE)

(73) Assignee: Dometic Sweden AB, Solna (SE)

( * ) Notice: Subject to any disclaimer, the term of this patent is extended or adjusted under 35 U.S.C. 154(b) by 120 days.

(21) Appl. No.: 10/758,174

(22) Filed: Jan. 15, 2004

(65) Prior Publication Data

US 2005/0115251 A1 Jun. 2, 2005

(30) Foreign Application Priority Data

Dec. 1, 2003 (SE) ..... 0303228

(51) Int. Cl.
*F25B 15/00* (2006.01)

(52) U.S. Cl. ..... 62/141; 62/441; 62/476

(58) Field of Classification Search ..... 62/141, 62/441, 408, 476, 478
See application file for complete search history.

(56) References Cited

U.S. PATENT DOCUMENTS

| | | | | |
|---|---|---|---|---|
| 4,242,879 | A | 1/1981 | Blomberg | |
| 4,296,613 | A * | 10/1981 | Eber | 62/515 |
| 4,922,730 | A * | 5/1990 | Schupbach et al. | 62/476 |
| 5,557,941 | A | 9/1996 | Hanson et al. | |
| 5,966,951 | A * | 10/1999 | Hallin et al. | 62/141 |
| 6,318,098 | B1 * | 11/2001 | Boxum | 62/183 |
| 2003/0070444 | A1 | 4/2003 | Muller et al. | |

FOREIGN PATENT DOCUMENTS

| | | | |
|---|---|---|---|
| DE | 42 10 603 A1 | | 10/1992 |
| DE | 196 34 687 A1 | | 3/1998 |
| FR | 2 816 699 | | 11/2000 |
| JP | 2002181402 A | * | 6/2002 |

* cited by examiner

*Primary Examiner*—Melvin Jones
(74) *Attorney, Agent, or Firm*—Pearne & Gordon LLP

(57) ABSTRACT

The present invention relates to an absorption refrigerator including a cabinet having outer walls and at least one door encasing a low temperature storage compartment and a higher temperature storage compartment, said compartments being separated by a partition wall, an absorption refrigerating system including an evaporator tube in which a refrigeration medium flows from an upstream end to a downstream end of the evaporator tube, and which evaporator tube comprises a first tube section which is arranged to absorb heat from the low temperature compartment, and at least a second tube section, which is arranged to absorb heat from the higher temperature compartment, a battery arranged to supply power to electronic equipment in said absorption refrigerating system, a control system arranged to control start and stop of said absorption refrigerating system to control the temperature in at least said higher temperature storage compartment to be within a specified temperature range, and a heater arranged in said higher temperature storage compartment provided to apply heat to said higher temperature compartment. The refrigerator is characterized in that said control system comprises a sensor arranged to detect if said battery is currently charged or if AC-power is available, and that said control system is arranged to set freezer control values to a first set of freezer control values if said battery is charged or if AC-power is available and to a second set of freezer control values if said battery is not charged or if AC-power is not available, where at least one of the values in said second set of freezer control values is higher than both values in said first set of freezer control values.

23 Claims, 4 Drawing Sheets

COOLING APPARATUS AND METHOD

TECHNICAL FIELD

The present invention relates to an apparatus for effective cooling of an absorption refrigerator comprising a cooling compartment and a freezing compartment and a method therefore. More specifically the present invention relates to an apparatus for effective cooling of an absorption refrigerator comprising a cooling compartment and a freezing compartment driven by one absorption cooler.

BACKGROUND OF THE INVENTION

The present invention relates to an absorption refrigerator including; a cabinet having outer walls and at least one door encasing a low temperature storage compartment and a higher temperature storage compartment, said compartments being separated by a partition wall, and an absorption refrigerating system including an evaporator tube in which a refrigeration medium flows from an upstream end to a downstream end of the evaporator tube, and which evaporator tube comprises a first tube section which is arranged to absorb heat from the low temperature compartment, a second tube section, which is arranged to absorb heat from the higher temperature compartment, wherein the first and second tube sections are connected in series and the first tube section is arranged upstream of the second tube section.

Such absorption refrigerators are commonly used e.g. in recreation vehicles, mobile homes or at homes were AC power supply is not available at all times.

Normally, at the prior art refrigerators of this type, the lower temperature compartment is a freezer, which at modern absorption refrigerators normally is maintained at −18° C.

The low temperature compartment is occasionally denoted freezer or freezer compartment, the higher temperature compartment is occasionally denoted fridge or fridge compartment and the cabinet, comprising the freezer and fridge compartments are occasionally denoted refrigerator, absorption refrigerator or refrigerator cabinet.

The freezer may also accommodate a device for fabrication of ice, often referred to as the ice-maker. The ice maker may in it's simplest form be an ice-cube container but it may also comprise more sophisticated devices with means for automatic water supply and ice harvesting means including mechanical members and electrical heating elements.

The higher temperature compartment is normally maintained at around +5° C. and could be referred to as a fridge compartment.

The evaporator tube may include an upstream tube section, which is dedicated for cooling the ice-maker, if present. Downstream of this ice-maker tube section and in direct connection to its downstream end, an intermediate tube section is arranged for cooling the freezer. Downstream of the freezer section, a downstream fridge section of the evaporator tube is arranged for cooling the higher temperature fridge compartment. At some applications both the freezer and the ice-maker are cooled together by one single evaporator tube section which is arranged upstream of the fridge tube section.

The evaporator may be provided with various types of heat conducting members for conducting heat from the items to be cooled, i.e. the freezer and fridge compartments and the ice maker, to the respective evaporator tube sections. As an example, the ice-maker section of the evaporator may be provided with a heat conducting plate, which is arranged to support the ice-cube container and which conducts heat from the container to the ice-maker section of the evaporator. The freezer and fridge sections may be provided with flanges or baffles, which conduct heat from the air in the freezer and fridge compartments to the evaporator freezer and fridge section respectively.

The evaporator reaches its lowest evaporation temperature at the upstream end. Downstream of the upstream end, the evaporation temperature rises gradually when the cooling medium in the evaporator tub absorbs heat from the ice-maker, freezer compartment and fridge compartment.

A problem at this known type of absorption refrigerator is that it is difficult to achieve a high enough cooling power of the refrigeration system to maintain the freezer compartment at the low temperature which is desired. As mentioned above, it is often desired to keep the temperature in the freezer compartment as low as approximately −18° C. The total cooling power of the absorption refrigerating apparatus is, among other factors such as ambient temperature, limited by the heat transfer capacity of the evaporator, which in turn depends on the total length of the evaporator tube. This length in turn, is limited by the dimensions of the refrigerator cabinet and by the fact that the evaporator tube needs to be designed with a downward inclination over its entire length, from the upstream to the downstream end.

When the absorption refrigerator is installed in an environment of relatively low temperature, for example 10° C., the proportion of operative phases of the absorption refrigerating system is reduced, resulting in an undesirable decrease in the performance of the freezer compartment.

The temperature in the freezer and fridge compartment are normally controlled by turning the refrigerating system on, when lower temperatures are required, and off, when the required temperatures has been achieved, respectively. To be able to achieve the required cooling level in the freezer compartment the refrigeration system, including the boiler, will have to be turned on more often than would be required to achieve the required temperature in the fridge compartment. This will in turn result in a lower temperature in the fridge compartment than preferable, which of course could have a detrimental effect on food stored in the fridge compartment.

At the upstream end of the evaporator tube, the evaporation temperature of the refrigeration medium is normally approximately −30° C. During manufacturing of ice, i.e. during freezing of water in the ice-maker, the ice-maker section of the evaporator absorbs heat from the ice-maker. This heat absorption rises the evaporation temperature of the refrigeration medium so that it, at the entrance of the freezer section of the evaporator tube, is approximately −24° C. and at the exit approximately −20° C. Thus, during manufacturing of ice, the average driving temperature difference between the desired freezer temperature and the evaporation temperature of the refrigeration medium would then be only about 2° C. Such a small driving temperature difference enhances the problems described above.

DE 196 34 687 A1 discloses a refrigerator using a heater in a fridge compartment to raise the temperature in the fridge compartment, when the requirements for lower temperature in the freezer compartments also lowers the temperature in the fridge compartment. This will of course require extra power to drive the heater element and would be a problem, which is accentuated in the case where the refrigerator, at least partly and occasionally is operated using batteries.

SUMMARY OF THE INVENTION

It is a main object of the present invention to provide such apparatus and method that at least alleviate the above problems.

It is in this respect a particular object of the invention to provide such apparatus and method that achieves preferred temperature ranges both in a fridge compartment and a freezer compartment in an absorption refrigerator.

It is still a further object of the invention to provide such apparatus and method that achieves the above objects during operation conditions requiring reduced power consumption. These objects among others are, according to a first aspect of the present invention, attained by an absorption refrigerator including a cabinet having outer walls and at least one door encasing a low temperature storage compartment and a higher temperature storage compartment, said compartments being separated by a partition wall, an absorption refrigerating system including an evaporator tube in which a refrigeration medium flows from an upstream end to a downstream end of the evaporator tube, and which evaporator tube comprises a first tube section which is arranged to absorb heat from the low temperature compartment, and at least a second tube section, which is arranged to absorb heat from the higher temperature compartment, a battery arranged to supply power to electronic equipment in said absorption refrigerating system, a control system arranged to control start and stop of said absorption refrigerating system to control the temperature in at least said higher temperature storage compartment to be within a specified temperature range, and a heater arranged in said higher temperature storage compartment provided to apply heat to said higher temperature compartment. The refrigerator is characterized in that said control system comprises a sensor arranged to detect if said battery is currently charged or if AC-power is available, and that said control system is arranged to set freezer control values to a first set of freezer control values if said battery is charged or if AC-power is available and to a second set of freezer control values if said battery is not charged or if AC-power is not available, where at least one of the values in said second set of freezer control values is higher than both values in said first set of freezer control values.

The above objects among others are, according to a second aspect of the present invention, attained by a method for controlling the temperature in an absorption refrigerator comprising the steps of: detecting if said battery is currently charged or if AC-power is available, setting freezer control values to a first set of freezer control values if said battery is charged or if AC-power is available, and setting said freezer control values to a second set of freezer control values if said battery is not charged or if AC-power is not available, wherein at least one of the values in said second set of freezer control values is higher than both values in said first set of freezer control values.

By changing the freezer control values depending on if the battery is currently charged or if AC-power is available it is possible to save DC-power when limited power is available.

According to one version of the invention said freezer control values are provided to control start and/or stop of said absorption refrigerating system.

By controlling start and/or stop of the cooler in dependence of the freezer control values better control of the temperature in the freezer and in the fridge is achieved.

According to another version said freezer control values are provided to control application of heat in said higher temperature compartment. According to an alternative the control thresholds for controlling the heater may be separate from the freezer control values.

By controlling start and/or stop of the heater in dependence of the freezer control values better control of the temperature in the freezer and in the fridge is achieved.

According to another version said freezer control values comprises a higher freezer temperature threshold and a lower freezer temperature threshold.

These higher and lower freezer temperature thresholds define a temperature range for control of the start and/or stop of, for instance the cooler or heater.

According to another version said control system is provided to control the temperature in said higher and lower temperature compartments by: starting said absorption refrigerating system if either the temperature in said higher temperature compartment is above said specified temperature range or the temperature in said lower temperature compartment is above said higher freezer temperature threshold, and stopping said absorption refrigerating system if both the temperature in said higher temperature compartment is below said specified temperature range, and the temperature in said lower temperature compartment is below said lower freezer temperature threshold.

If the temperature in both compartments are allowed into the control mechanism it is possible to achieve better temperature characteristics in the respective compartments.

According to another version said control system is provided to control the temperature in said higher temperature storage compartment by starting said absorption refrigerating system if the temperature in said higher temperature storage department is above said specified temperature range and stop said absorption refrigerating system if the temperature in said higher temperature storage department is below said specified temperature range.

Thus it is possible to control start and stop of the cooler only in dependence of the temperature in the fridge.

According to another version said control system is provided to apply heat to said higher temperature compartment if the temperature in said higher temperature compartment is below a first specified temperature and stop application of heat if the temperature in said higher temperature compartment rises above a second specified temperature.

Since the system only has one cooling unit it may occasionally be so that the freezer requires the cooler to be started or to continue to run, while the temperature in the fridge should not be allowed to be lower. In this case the heater is used to apply heat in the fridge to raise, or at least to maintain, the temperature therein.

According to another version said control system is provided to stop application of heat to said higher temperature compartment if the temperature in said lower temperature compartment is below said lower freezer temperature threshold. If the temperature in the freezer is below the lower freezer threshold, application of heat in the fridge should be stopped so that the temperature in the fridge is allowed to drop below the lower fridge threshold, when the warming power of the heater is greater than the cooling power in the fridge. Thereupon, the cooler is stopped.

By operating a heater arranged in the high temperature compartment in dependence of the temperature in the freezer compartment and/or the fridge compartment the temperature in the two different compartments can be kept within defined limits.

According to another version the battery powers the heater, fans, control system etc. as well as other RV appliances.

According to another version the heater is also used for defrosting purposes. Thus it is not necessary to provide a specific heater for the purpose of defrosting. According to another version said first set of freezer control values comprises a higher freezer temperature threshold in the range of −14° to −18° Celsius, preferably −16° Celsius, and a lower freezer temperature threshold in the range of −20° to −16° Celsius, preferably −18° Celsius, and—said second set of freezer control values comprises a higher freezer temperature threshold in the range of −10° to −14° Celsius, preferably −12° Celsius, and a lower freezer temperature threshold in the range of −16° to −12° Celsius, preferably −14° Celsius.

Since only one cooler is used it is not possible to independently control the temperature in both the fridge and the freezer by simply starting and stopping the cooler. Also, the goods in the fridge is more sensitive to variations than the goods in the freezer. Thus, it is preferably to regulate the start and stop of the cooler depending on the temperature in the fridge compartment, rather than on the temperature in the freezer compartment. However, as is stated above, it is also possible to control on both compartments.

The above objects among others are, according to a third aspect of the present invention, attained by a method for controlling the temperature in an absorption refrigerator, wherein said refrigerator includes a cabinet having outer walls and at least one door encasing a low temperature storage compartment and a higher temperature storage compartment, said compartments being separated by a partition wall, an absorption refrigerating system including an evaporator tube in which a refrigeration medium flows from an upstream end to a downstream end of the evaporator tube, and which evaporator tube comprises a first tube section which is arranged to absorb heat from the low temperature compartment, and at least a second tube section, which is arranged to absorb heat from the higher temperature compartment, and a heater arranged in said higher temperature storage compartment provided to apply heat to said higher temperature compartment.

The method is characterized in the steps of: starting said absorption refrigerating system if either the temperature in said higher temperature compartment is above said specified temperature range, or the temperature in said lower temperature compartment is above a higher freezer temperature threshold, and stopping said absorption refrigerating system if both the temperature in said higher temperature compartment is below said specified temperature range, and the temperature in said lower temperature compartment is below a lower freezer temperature threshold.

According to one version of the invention the application of heat in said higher temperature compartment is controlled in dependence of the temperature in said low temperature compartment and said lower and higher freezer temperature thresholds.

According to another version the method comprises the further steps of: applying heat to said higher temperature compartment if the temperature in said higher temperature compartment is below a first specified temperature, and stopping application of heat to said higher temperature compartment if the temperature in said higher temperature compartment is above a second specified temperature.

According to another version the method comprises the further step of: stopping application of heat to said higher temperature compartment if the temperature in said lower temperature compartment is below said lower freezer temperature threshold.

Further characteristics of the invention and advantages thereof will be evident from the following detailed description of embodiments of the invention.

BRIEF DESCRIPTION OF THE DRAWINGS

The present invention will become more fully understood from the detailed description of embodiments of the present invention given herein below and the accompanying FIGS. 1 to 4, which are given by way of illustration only, and thus are not limitative of the present invention.

PREFERRED EMBODIMENTS

Figure 1:
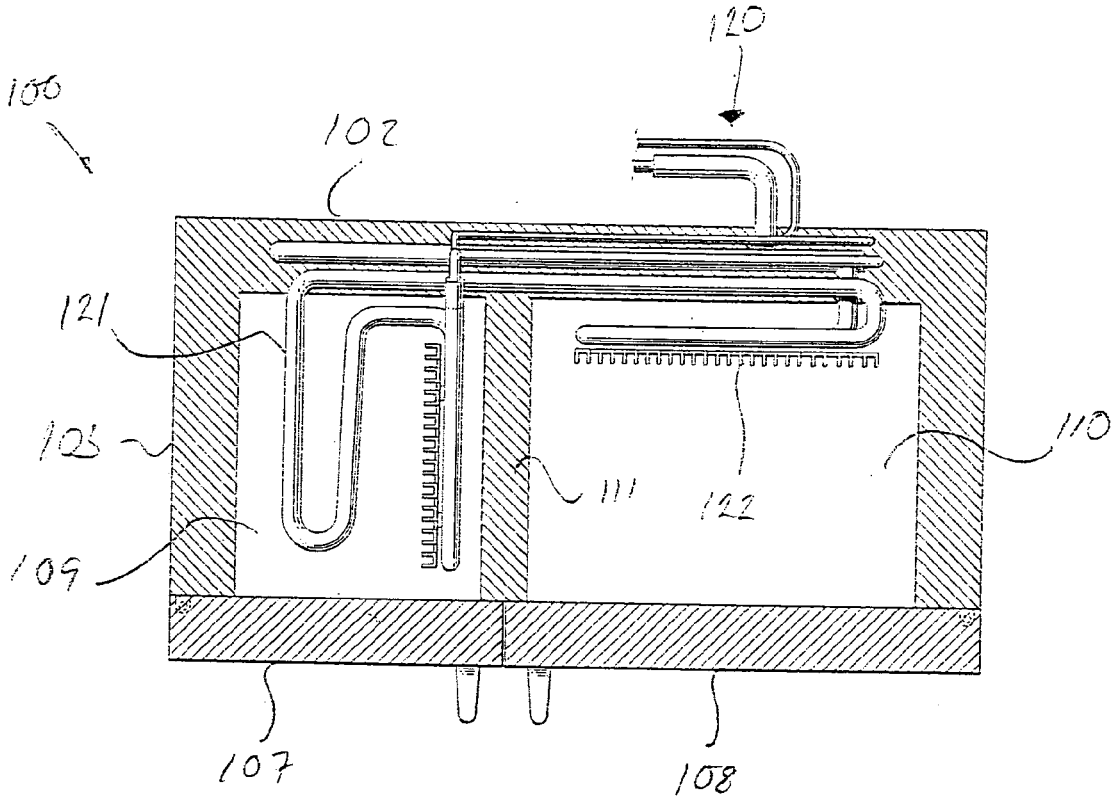
FIG. 1 is a top elevation view, with parts of the walls broken away, of a refrigerator cabinet according to the present invention.

In the following description, for purposes of explanation and not limitation, specific details are set forth, such as particular techniques and applications in order to provide a thorough understanding of the present invention. However, it will be apparent to one skilled in the art that the present invention may be practiced in other embodiments that depart from these specific details. In other instances, detailed descriptions of well-known methods and apparatuses are omitted so as not to obscure the description of the present invention with unnecessary details.

In the figures a side-by-side absorption refrigerator 100 is shown. The cabinet includes a rear wall 102, and two side walls 103, 104. A top-wall and a bottom-wall is also included but not shown in FIG. 1. These outer walls, together with two front doors 107, 108 enclose a low temperature storage compartment 109 and a higher temperature storage compartment 110. The outer walls and the front doors 107, 108 all include an outer and an inner shell between which heat-insulating material, such as polyurethane foam, is arranged. The two compartments 109, 110 are hermetically sealed from each other by a vertical partition wall 111, which extends perpendicular to and from the rear wall 102, between the rear wall 102 and the front of the cabinet 100, in such away that the doors 107 and 108, when closed, sealingly rest against the front of the partition wall 111. The front door 107, the partition wall 111, the sidewall 103 and respective portions of the rear wall, top wall and bottom wall thus define the freezer compartment 109. The front door 108, the partition wall 111, the sidewall 104 and respective portions of the rear wall, top wall and bottom wall analogously define the higher temperature compartment 110. The partition wall is placed approximately ⅓ of the total width of the cabinet from one sidewall 103, so that the width-relationship between the freezer compartment 109 and the fridge compartment 110 is approximately 1:2.

During operation, the temperature in the freezer compartment 109 is normally kept at about −18° C., whereas the higher temperature compartment 110 normally is kept at about +5° C. The higher temperature compartment 110 could also be referred to as a fridge compartment.

An absorption refrigerator system including a conventional boiler, condenser, and absorber (neither of which is shown in FIG. 1) is arranged at the back of the cabinet, outside the rear wall 102. The refrigerator system also includes an evaporator, generally indicated by reference number 120. The evaporator 120 is formed of an evaporator tube, which includes a first evaporator tube section 121 for cooling the freezer compartment 109 and a second evaporator tube section 122 for cooling the higher temperature compartment 110. The first section 121 is arranged inside the freezer compartment 109 and the second section 122 inside the higher temperature compartment 110 at a lower elevation than the first section so that cooling liquid may be transported from the first section 121 to the second section 122 by gravity.

Figure 2:
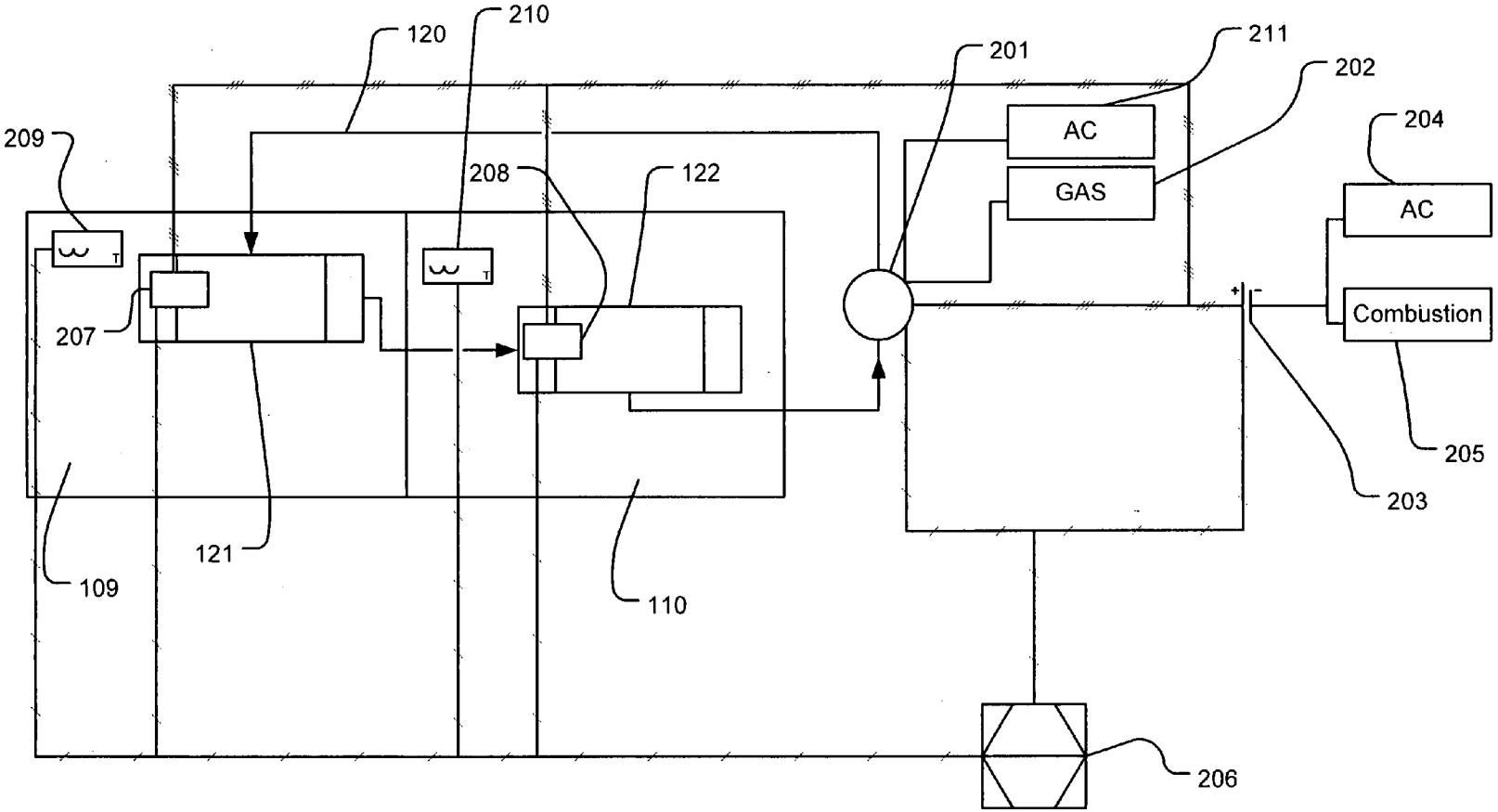
FIG. 2 is a schematic block diagram of a refrigerator according to a preferred embodiment of the present invention.

FIG. 2 is a schematic block diagram of the invention according to a preferred embodiment. An absorption refrigerator system is schematically disclosed and denoted 201. The refrigerator system 201 includes a conventional boiler, condenser, and absorber, as well as any other conventional technology for the operation of the refrigerator system 201, for instance valves and the like. A gas source 202, an AC-source 211 and a battery 203 are connected to the refrigerator system 201 in a conventional manner.

The battery 203 may be charged through mains 204 or through a connection to a generator on a combustion engine 205, for instance on a motor vehicle. During charging of the battery 203 the voltage level of the battery 203 is higher than when no charging occurs. A computer, or a control system 206, measures the voltage level of the battery or alternatively detects if AC-power is available. The battery is further connected to a first heating element 207, provided on the first evaporator tube section 121, for providing power to the heating element 207 and to a second heating element 208, provided on the second evaporator tube section 122, for providing power to the second heating element 208. The heating elements 207 and 208 are primarily provided to achieve automatic defrosting of the freezer compartment 109 and the higher temperature compartment 110, but the second heating element will provide additional functionality according to the present invention as will be further described below.

The control system 206 is further connected to the refrigerator system 201 for controlling the start and stop of the refrigerator system 201 and to the first and second heating elements 207 and 208 for controlling the application of heat to the freezer compartment 109 and the higher temperature compartment 110, respectively. A first temperature-measuring device 209 is provided in the freezer compartment 109 for measuring the temperature in the freezer compartment 109 and is connected to the control system 206. A second temperature-measuring device 210 is provided in the higher temperature compartment 110 for measuring the temperature in the higher temperature compartment 110 and is also connected to the control system 206.

The operation of the refrigerator according to the invention will now be described in connection with FIG. 3.

Figure 3:
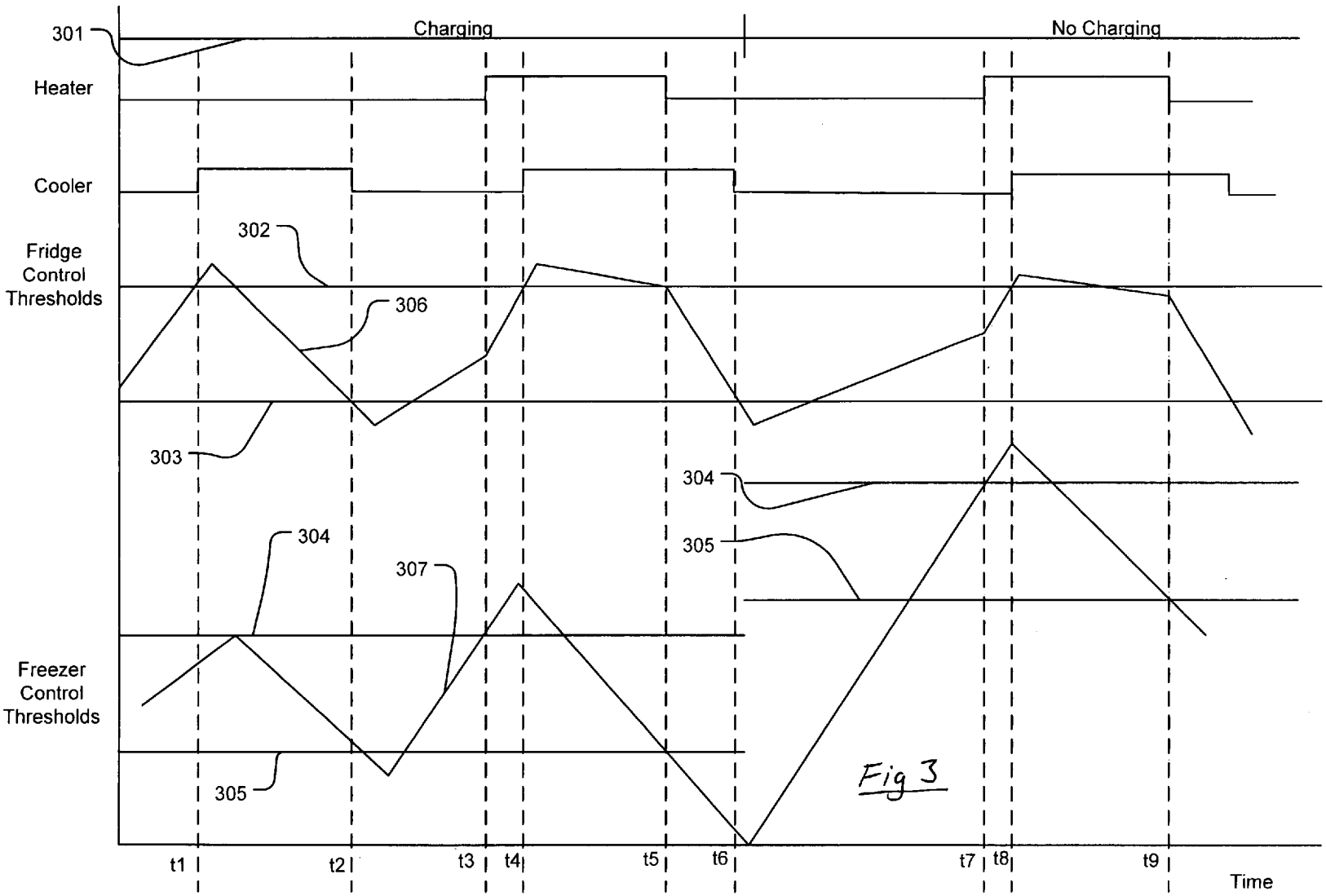
FIG. 3 is a schematic exemplary time diagram of the operation of a refrigerator according to a preferred embodiment of the present invention.

FIG. 3 is a schematic exemplary time diagram of the operation of a refrigerator according to a preferred embodiment of the invention. It should be noted that diagram in FIG. 3 is constructed to display the characteristic operation of the refrigerator according to the invention and should not be interpreted in a restrictive manner.

The control system 206 will operate the refrigerator system 201 according to two different schemes, depending on if the battery 203 is charged or not. The battery is charged if the refrigerator is connected to mains 204 or if the motor of the vehicle, in which the refrigerator is mounted, is running. This is detected by the control system by sensing the voltage across the battery. The voltage is higher across the battery 203 if the battery 203 is charged, than if not. Alternatively the control system may directly detect if AC-power is available, rather than to detect the voltage level over the battery.

FIG. 3 shows charging of the battery with line 301. The control system 206 will keep the temperature in the freezer compartment and the higher temperature compartment 109 and 110, respectively, as measured with temperature measuring device 209 and 210, respectively, within defined tolerances. This is achieved by setting cut-in 302 and cut-out 303 values for the start and stop of the refrigerating system 201, denoted cooler in FIG. 3. When the temperature in the higher temperature compartment 110 rises above the cut-in value 302 the refrigerating system, or cooler, 201 is started. When the temperature in the higher temperature compartment 110, as measured by the temperature measuring device 210, falls below the cut-out value 303 the refrigerating system 201 is stopped.

Since both the freezer compartment 109 and the higher temperature compartment 110 are cooled using a single refrigerating system 201 it is not possible to control the temperature in each compartment independently. Thus, the temperature in the freezer compartment 109 will depend upon the start and stop of the refrigerating system 201, as determined by the temperature in the higher temperature department 110.

Therefore, the control system 206 also monitors the temperature in the freezer compartment 109 and defines a cut-in 304 and a cut-out 305 value for application of heat in the higher temperature compartment 110. When the temperature in the freezer compartments 109 rises above the cut-in value 304 the control system 206 starts the heating element 210 in the higher temperature compartment 110, and when the temperature in the freezer compartment 109, as measured by the temperature measuring device 209, falls below the cut-out value 305 the control system 206 stops the heating element 210 in the higher temperature compartment 110.

In FIG. 3 the temperature in the higher temperature compartment 110 is shown by a line and is denoted 306 and the temperature in the freezer compartment 109 is shown by a line denoted 307. At time $t_1$ the temperature in the higher temperature compartment rises above the cooler cut-in value and the cooler 201 is started. After a slight delay the temperature in the higher temperature compartment 110 and in the freezer compartment 109 drops. At time $t_2$ the temperature in the high temperature compartment has fallen below the cooler cut-out value and the cooler is stopped. As can be seen in FIG. 3, the temperature in the refrigerator starts to rise after a short delay. The rise is more rapid in the freezer compartment 109 than in the high temperature compartment 110 and thus at time $t_3$ the temperature in the freezer compartment rises above the heater cut-in value. The control system 206 starts the heater in the high temperature compartment 110 and, as can be seen in FIG. 3, the temperature rise in the high temperature compartment 110 is sharper as an effect of the application of heat and at time $t_4$ the temperature in the high temperature compartment rises above the cooler cut-in value.

As can be seen in FIG. 3, the application of heat in the fridge compartment will make the temperature increase more rapid and thus reduce the time remaining before the cooler is started. When the cooler starts the temperature in the high temperature compartment 110 as well as the temperature in the freezer compartment 109 drops. At this period both the cooler, or refrigerating system, 201 and the heater in the high temperature compartment 110 are operational and thus the temperature in the high temperature compartment 110 is not dropping as rapid as during the previous phase when the cooler was operating. At time $t_5$ the temperature in the freezer compartment falls below the heater cut-out value and the heater in the high temperature compartment 110 is stopped. This have the effect of a more rapid drop in temperature in the high temperature compartment 110 and at time $t_6$ the temperature is below the cooler cut-out value and the cooler 201 is stopped.

At this time the control system 206 detects that the charging to the battery 203 has ceased. To save DC-energy, primarily by reducing the time the heater in the high temperature compartment 110 is operated, the heater cut-in and cut-out values 304 and 305, respectively, are raised, as is indicated in FIG. 3. Besides this the operation of the refrigerator is the same has has been described earlier. Thus, at time $t_7$ the temperature in the freezer compartment has risen above the new heater cut-in value 304 and the heater in the high temperature compartment 110 is started. At time $t_8$ the temperature in the high temperature compartment 110 is above the cooler cut-in value and the cooler 201 is started and at time $t_9$ the temperature in the freezer compartment 109 has drop below the new heater cut-out value and the heater in the high temperature compartment 110 is turned off.

Raising the heater cut-in and heater cut-out values when no charging is available to the battery 203 has the effect that the temperature in the freezer compartment is allowed be slightly higher than when charging is available. This will in turn mean that the heater in the high temperature compartment 110 is not operated as frequent and not as long when no charging is available, thus saving valuable battery power.

Figure 4:
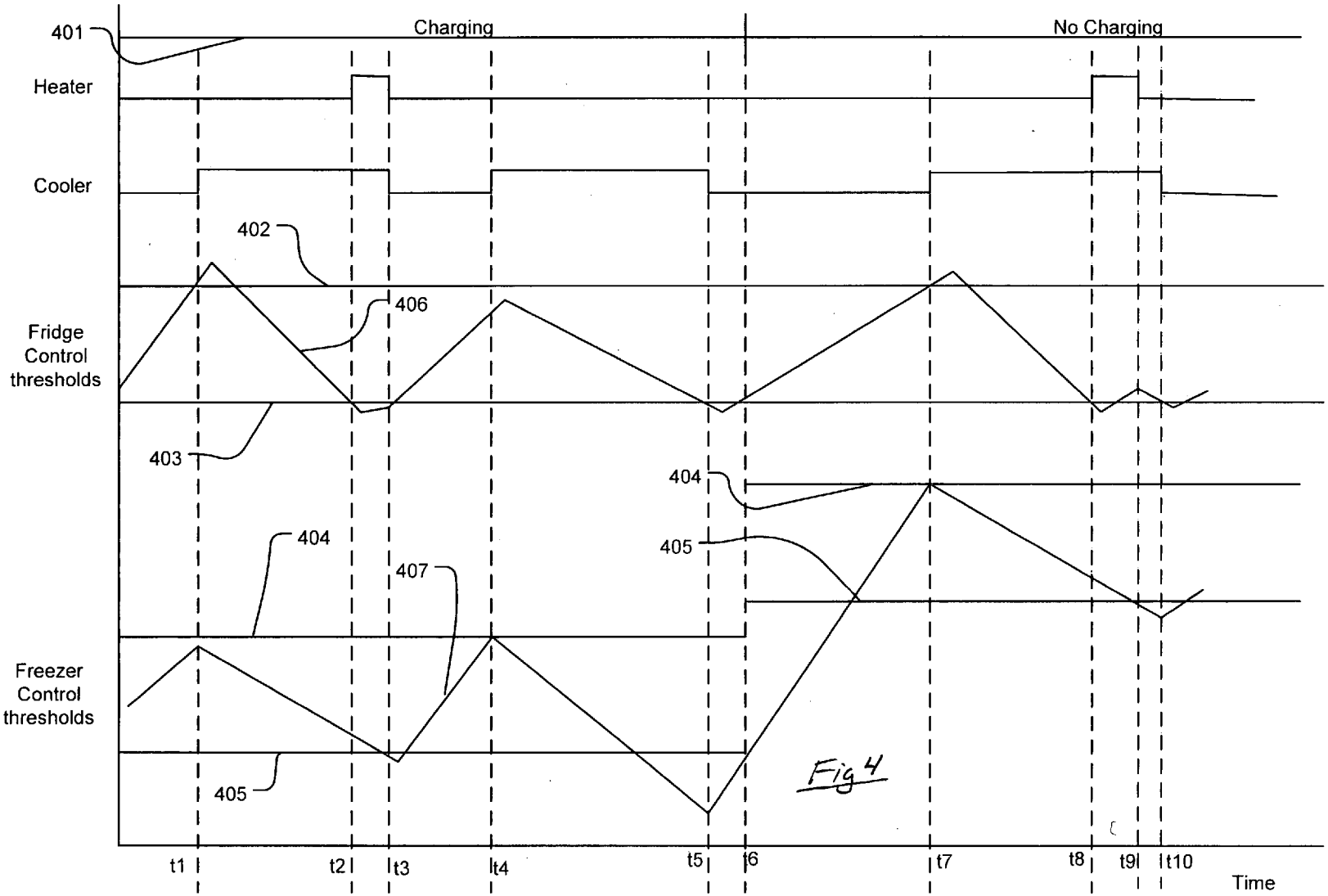
FIG. 4 is a schematic exemplary time diagram of the operation of a refrigerator according to another preferred embodiment of the present invention.

FIG. 4 is a schematic exemplary time diagram of the operation of a refrigerator according to another preferred embodiment of the invention. It should be noted that diagram in FIG. 4 is constructed to display the characteristic operation of the refrigerator according to the invention and should not be interpreted in a restrictive manner.

In the embodiment disclosed in FIG. 4 the start and stop of the cooler 201 is determined based on the temperature in both the fridge compartment 109 and the freezer compartment 110. The start and stop of application of heat, by the heating element 207, to the fridge is also determined based on the temperature in both compartments 109 and 110, respectively.

As in the previous embodiment different higher 404 and lower 405 freezer temperature thresholds are set depending on if the battery is charged as indicated with line 401 in FIG. 4. The specified fridge temperature range, as defined by higher fridge temperature threshold 402 and lower fridge temperature threshold 403, is kept constant as in the previous embodiment. The air temperature in the fridge compartment 110 is plotted and denoted 406 in FIG. 4, and the air temperature in the freezer compartment 109 is plotted and denoted 407 in FIG. 4.

At time $t_1$ the temperature in the fridge rises above the higher fridge threshold and thus the cooler 201 is started. This has the effect that the temperature in both compartments 109 and 110 drops as is indicated in FIG. 4. At time $t_2$ the temperature in the fridge compartment 110 has reached to lower fridge threshold, but since the freezer compartment 109 has not reached the lower freezer threshold the cooler is not stopped but heat is applied in the fridge by heating element 208.

Thus, the requirement for stopping the cooler 201 is that the temperature in both compartments 109 and 110 has reached respective lower temperature thresholds.

Since, in this embodiment, the heating power is somewhat higher than the cooling power in the fridge compartment the temperature in the fridge compartment will rise slowly as is indicated in FIG. 4.

At time $t_3$ the temperature in the freezer has reached the lower freezer threshold and the heating element 208 is switched off. Since the temperature in the fridge is below the lower fridge threshold also the cooler is stopped. It should be noted that, even though the lower freezer threshold is used both to take decisions regarding to stop the cooler as well as to stop application of heat, it is possible to use separate threshold for these two decisions.

At time $t_4$ the temperature in the freezer has reached the higher freezer threshold and the cooler is started. Thus, in general terms, the cooler is started if either the fridge temperature is above the higher fridge threshold, or if the temperature in the freezer reaches above the higher freezer threshold. Since the cooler is operating the temperature in both compartments drop. At time $t_5$ the temperature in the fridge drops below the lower fridge threshold and the cooler is once again stopped. The temperature in the freezer has already passed the lower freezer threshold, but the requirement for stopping the cooler is that the temperature in both compartments should be below respective thresholds, which is fulfilled at time $t_5$.

At time $t_6$ the charging to the battery 401 ceases and thus are the freezer control values changed, that is the higher and lower freezer thresholds are increased.

The control of the start and stop of the cooler as well as start and stop of the heating element continues as before with the new freezer control values. Thus, at time $t_7$ the fridge temperature reaches the higher fridge threshold and the cooler 201 is started. It is noted that the freezer temperature long before that passed the old higher freezer threshold, but since new thresholds apply the cooler 201 was not started.

At time $t_8$ the heater is started. At time $t_9$ the heater is switched off since the temperature in the freezer has reached the new low freezer threshold but the cooler is kept on since the temperature in the fridge has had time to go over the low fridge threshold. At time $t_{10}$ the temperature in both compartments are below respective thresholds so the cooler is stopped.

How fast the fridge and freezer absorbs heat from the environment and cools down when the cooler is running, that is, the inclinations of the temperature plots 406 and 407, is dependent on a number of different parameters, such as ambient temperature, the number of door openings, how much goods are placed in the respective compartments etc.

It should be clear that the heater in the high temperature compartment 110 is not operating as a defrosting element in the present innovative application.

It will be obvious that the invention may be varied in a plurality of ways. Such variations are not to be regarded as a departure from the scope of the invention. All such modifications as would be obvious to one skilled in the art are intended to be included within the scope of the appended claims.

What is claimed is:

1. Absorption refrigerator (1) including a cabinet having outer walls (2, 3, 4, 5, 6) and at least one door (7, 8) encasing a low temperature storage compartment (9) and a higher temperature storage compartment (10), said compartments being separated by a partition wall (11), an absorption refrigerating system including an evaporator tube (20) in which a refrigeration medium flows from an upstream end to a downstream end of the evaporator tube, and which evaporator tube comprises a first tube section (21) which is arranged to absorb heat from the low temperature compartment, and at least a second tube section (22), which is arranged to absorb heat from the higher temperature compartment, a battery arranged to supply power to electronic equipment in said absorption refrigerating system, a control system arranged to control start and stop of said absorption refrigerating system to control the temperature in at least said higher temperature storage compartment to be within a specified temperature range, and a heater arranged in said higher temperature storage compartment provided to apply heat to said higher temperature compartment, characterized in that, said control system comprises a sensor arranged to detect if said battery is currently charged or if AC-power is available, said control system is arranged to set freezer control values to a first set of freezer control values if said battery is charged or if AC-power is available and to a second set of freezer control values if said battery is not charged or if AC-power is not available, where at least one of the values in said second set of freezer control values is higher than both values in said first set of freezer control values.

2. Absorption refrigerator according to claim 1, wherein said freezer control values are provided to control start and/or stop of said absorption refrigerating system.

3. Absorption refrigerator according to claim 1, wherein said freezer control values are provided to control application of heat in said higher temperature compartment.

4. Absorption refrigerator according to claim 1, wherein said freezer control values comprises a higher freezer temperature threshold and a lower freezer temperature threshold.

5. Absorption refrigerator according to claim 4, wherein said control system is provided to control the temperature in said higher and lower temperature compartments by:

starting said absorption refrigerating system if either the temperature in said higher temperature compartment is above said specified temperature range or the temperature in said lower temperature compartment is above said higher freezer temperature threshold, and stopping said absorption refrigerating system if both the temperature in said higher temperature compartment is below said specified temperature range, and the temperature in said lower temperature compartment is below said lower freezer temperature threshold.

6. Absorption refrigerator according to claim 1, wherein said control system is provided to control the temperature in said higher temperature storage compartment by starting said absorption refrigerating system if the temperature in said higher temperature storage department is above said specified temperature range and stop said absorption refrigerating system if the temperature in said higher temperature storage department is below said specified temperature range.

7. Absorption refrigerator according to claim 1, wherein said control system is provided to apply heat to said higher temperature compartment if the temperature in said higher temperature compartment is below a first specified temperature and stop application of heat if the temperature in said higher temperature compartment rises above a second specified temperature.

8. Absorption refrigerator according to claim 4, wherein said control system is provided to stop application of heat to said higher temperature compartment if the temperature in said lower temperature compartment is below said lower freezer temperature threshold.

9. Absorption refrigerator according to claim 1, wherein said heater is powered by said battery.

10. Absorption refrigerator according to claim 1, wherein said heater is also used for defrosting purposes.

11. Absorption refrigerator according to claim 2, wherein said first set of freezer control values comprises a higher freezer temperature threshold in the range of −14° to −18° Celsius, preferably −16° Celsius, and a lower freezer temperature threshold in the range of −20° to −16° Celsius, preferably −18° Celsius, and said second set of freezer control values comprises a higher freezer temperature threshold in the range of −10° to −14° Celsius, preferably −12° Celsius, and a lower freezer temperature threshold in the range of −16° to −12° Celsius, preferably −14° Celsius.

12. Method for controlling the temperature in an absorption refrigerator (1), wherein said refrigerator includes a cabinet having outer walls (2, 3, 4, 5, 6) and at least one door (7, 8) encasing a low temperature storage compartment (9) and a higher temperature storage compartment (10), said compartments being separated by a partition wall (11), an absorption refrigerating system including an evaporator tube (20) in which a refrigeration medium flows from an upstream end to a downstream end of the evaporator tube, and which evaporator tube comprises a first tube section (21) which is arranged to absorb heat from the low temperature compartment, and at least a second tube section (22), which is arranged to absorb heat from the higher temperature compartment, a battery arranged to supply power to said absorption refrigerating system during at least part of the operating time for said absorption refrigerator, and a heater arranged in said higher temperature storage compartment provided to apply heat to said higher temperature compartment, characterized in the steps of, detecting if said battery is currently charged or if AC-power is available, setting freezer control values to a first set of freezer control values if said battery is charged or if AC-power is available, and setting said freezer control values to a second set of freezer control values if said battery is not charged or if AC-power is not available, wherein at least one of the values in said second set of freezer control values is higher than both values in said first set of freezer control values.

13. The method according to claim 12, comprising the step of:

controlling start and/or stop of said absorption refrigerating system in dependence of the temperature in said low temperature compartment and said freezer control values.

14. The method according to claim 12, comprising the step of:

controlling application of heat in said higher temperature compartment in dependence of the temperature in said low temperature compartment and said freezer control values.

15. The method according to claim 12, wherein said freezer control values comprises a higher freezer temperature threshold and a lower freezer temperature threshold.

16. The method according to claim 15, comprising the step of:

starting said absorption refrigerating system if either the temperature in said higher temperature compartment is above a specified temperature range or the temperature in said lower temperature compartment is above said higher freezer temperature threshold, and stopping said absorption refrigerating system if both the temperature in said higher temperature compartment is below said specified temperature range, and the temperature in said lower temperature compartment is below said lower freezer temperature threshold.

17. The method according to claim 12, comprising the steps of:

controlling the temperature in said higher temperature storage compartment by starting said absorption refrigerating system if the temperature in said higher temperature storage department is above a specified temperature range, and stopping said absorption refrigerating system if the temperature in said higher temperature storage department is below said specified temperature range.

18. The method according to claim 12, comprising the steps of:

applying heat to said higher temperature compartment if the temperature in said higher temperature compartment is below a first specified temperature and stopping application of heat to said higher temperature compartment if the temperature in said higher temperature compartment is above a second specified temperature.

19. The method according to claim 15, comprising the step of:

stopping application of heat to said higher temperature compartment if the temperature in said lower temperature compartment is below said lower freezer temperature threshold.

20. Method for controlling the temperature in an absorption refrigerator (1), wherein said refrigerator includes a cabinet having outer walls (2, 3, 4, 5, 6) and at least one door (7, 8) encasing a low temperature storage compartment (9) and a higher temperature storage compartment (10), said compartments being separated by a partition wall (11), an absorption refrigerating system including an evaporator tube (20) in which a refrigeration medium flows from an upstream end to a downstream end of the evaporator tube, and which evaporator tube comprises a first tube section (21) which is arranged to absorb heat from the low temperature compartment, and at least a second tube section (22), which is arranged to absorb heat from the higher temperature compartment, and a heater arranged in said higher temperature storage compartment provided to apply heat to said higher temperature compartment, characterized in the steps of, starting said absorption refrigerating system if either the temperature in said higher temperature compartment is above said specified temperature range or the temperature in said lower temperature compartment is above a higher freezer temperature threshold, and stopping said absorption refrigerating system if both the temperature in said higher temperature compartment is below said specified temperature range, and the temperature in said lower temperature compartment is below a lower freezer temperature threshold.

21. The method according to claim 20, comprising the step of:

controlling application of heat in said higher temperature compartment independence of the temperature in said low temperature compartment and said lower and higher freezer temperature thresholds.

22. The method according to claim 20, comprising the steps of:

applying heat to said higher temperature compartment if the temperature in said higher temperature compartment is below a first specified temperature and stopping application of heat to said higher temperature compartment if the temperature in said higher temperature compartment is above a second specified temperature.

23. The method according to claim 20, comprising the step of:

stopping application of heat to said higher temperature compartment if the temperature in said lower temperature compartment is below said lower freezer temperature threshold.

* * * * *

UNITED STATES PATENT AND TRADEMARK OFFICE

CERTIFICATE OF CORRECTION

PATENT NO. : 7,062,928 B2
APPLICATION NO. : 10/758174
DATED : June 20, 2006
INVENTOR(S) : Karlsson et al.

It is certified that error appears in the above-identified patent and that said Letters Patent is hereby corrected as shown below:

Column 14

Claim 21, line 30, please delete “independence” and insert therefor -- in dependence --.

Signed and Sealed this

Fourteenth Day of November, 2006

JON W. DUDAS
*Director of the United States Patent and Trademark Office*